US007089599B2

(12) United States Patent
Gouldson et al.

(10) Patent No.: US 7,089,599 B2
(45) Date of Patent: Aug. 15, 2006

(54) NESTABLE PINCH-GRIP HANGERS

(75) Inventors: Stanley F. Gouldson, Northport, NY (US); Olaf F. Olk, Hauppauge, NY (US)

(73) Assignee: Spotless Plastics Pty. Ltd., Moorabbin (AU)

( * ) Notice: Subject to any disclaimer, the term of this patent is extended or adjusted under 35 U.S.C. 154(b) by 466 days.

(21) Appl. No.: 10/367,231

(22) Filed: Feb. 14, 2003

(65) Prior Publication Data

US 2003/0222108 A1 Dec. 4, 2003

Related U.S. Application Data

(63) Continuation-in-part of application No. 10/076,790, filed on Feb. 15, 2002, and a continuation-in-part of application No. 10/292,128, filed on Nov. 12, 2002, now Pat. No. 6,923,350.

(51) Int. Cl.
*A41D 3/02* (2006.01)

(52) U.S. Cl. ..... 2/85; 2/93; 2/96

(58) Field of Classification Search ..... 223/93, 223/85, 96, 90, 91, 94, 89
See application file for complete search history.

(56) References Cited

U.S. PATENT DOCUMENTS

| | | | | | |
|---|---|---|---|---|---|
| 2,741,408 | A | * | 4/1956 | Brokenshire | 223/88 |
| 3,115,286 | A | * | 12/1963 | Bassin | 223/96 |
| 3,824,671 | A | | 7/1974 | Watkin | |
| 3,859,710 | A | | 1/1975 | Batts et al. | |
| 3,946,915 | A | * | 3/1976 | Crane | 223/96 |
| 4,349,127 | A | | 9/1982 | Savard, Jr. | |
| 4,381,599 | A | | 5/1983 | Duester et al. | |
| 4,383,362 | A | | 5/1983 | Graniero et al. | |
| 4,873,878 | A | | 10/1989 | Milton | |
| 5,238,159 | A | * | 8/1993 | Zuckerman | 223/85 |
| 5,272,806 | A | | 12/1993 | Marshall et al. | |
| 5,285,566 | A | | 2/1994 | Marshall et al. | |
| 5,507,086 | A | | 4/1996 | Marshall et al. | |
| 5,568,685 | A | | 10/1996 | Marshall et al. | |
| 5,604,975 | A | * | 2/1997 | Marshall et al. | 29/787 |
| 5,683,018 | A | * | 11/1997 | Sullivan et al. | 223/85 |
| 6,019,261 | A | * | 2/2000 | Morgan et al. | 223/96 |
| 6,050,461 | A | * | 4/2000 | Batts et al. | 223/96 |
| 6,202,906 | B1 | * | 3/2001 | Zuckerman | 223/96 |
| 6,260,745 | B1 | * | 7/2001 | Gouldson et al. | 223/85 |
| 6,264,075 | B1 | * | 7/2001 | Gouldson et al. | 223/85 |
| 6,382,478 | B1 | * | 5/2002 | Gouldson et al. | 223/85 |
| 6,421,910 | B1 | | 7/2002 | Marshall et al. | |
| 6,923,350 | B1 | * | 8/2005 | Gouldson et al. | 223/96 |
| 2003/0155387 | A1 | * | 8/2003 | Gouldson et al. | 223/93 |
| 2003/0209577 | A1 | * | 11/2003 | Gouldson et al. | 223/85 |

(Continued)

FOREIGN PATENT DOCUMENTS

GB 2266659 A * 11/1993

*Primary Examiner*—Rodney M. Lindsey
(74) *Attorney, Agent, or Firm*—Scully, Scott, Murphy & Presser, P.C.

(57) ABSTRACT

A nestable hanger including: a support means for supportably hanging the hanger on a display; a body supported by the support means and having two pinch grips disposed thereon for retaining a garment therein; where the hanger nests in a stack of similar hangers such that the hanger interlocks with the stack of similar hangers. The hanger can be in a plane substantially parallel with a plane of the stack of similar hangers, or alternatively, in substantially a same plane as the stack of similar hangers.

41 Claims, 13 Drawing Sheets

U.S. PATENT DOCUMENTS

2003/0222108 A1* 12/2003 Gouldson et al. ..... 223/91

2004/0159685 A1* 8/2004 Gouldson ..... 223/85

* cited by examiner

NESTABLE PINCH-GRIP HANGERS

CROSS REFERENCE TO RELATED APPLICATIONS

This application is a continuation-in-part of U.S. application Ser. No. 10/076,790, filed Feb. 15, 2002, and Ser. No. 10/292,128, filed Nov. 12, 2002, now U.S. Pat. No. 6,923, 350 the contents of which are incorporated herein by their reference.

BACKGROUND OF THE INVENTION

1. Field of the Invention

The present invention relates generally to hangers, and more particularly, to nestable pinch-grip hangers for shipping in containers. The pinch grip hangers are used for hanging pants and skirts for shipment to retailers and display of the same in a retail environment. The improved pinch-grip hangers are nestable in stacks and as such, are less costly to ship with or without garments attached thereto and easier to feed into automated production machinery.

2. Prior Art

Consumer taste and fashion have dictated a desire for mass-produced, but well-fitted garments, which are distributed and sold throughout the United States. Large national retailers of clothing generally contract with a plurality of clothing manufacturers to produce uniform standardized clothing, which is essentially identical from batch to batch, even though manufactured by different entities. These manufacturers in turn produce the clothing at their own plants, or in many cases, subcontract the production of the garments to manufacturers based in the Far East, for instance, in Hong Kong, Taiwan, Singapore and South Korea.

In the retail clothing industry clothing is typically suspended from hangers at the point of purchase. Such hangers are often inexpensive ship-on types and under prevailing garment-on-hanger programs, the garment is shipped from the manufacturer to the retailer while suspended from a hanger. Traditional garment-on-hanger pant and skirt hangers used spring clips that were manually pushed into a locking position to secure the pants or skirts to the hanger. In these hangers, a steel-retaining clip was manually clamped over a clamshell garment grip to secure the garment. Use of the hangers in this device required a manual operation to slide the steel clip over the clamshell to close the retention clip on the garment.

However, these hangers were not popular as the physical force needed to close a hanger on a thick waist band could result in increased time and labor costs to load the hanger and complaints of inadvertently broken finger nails were common. For these reasons, pinch grip hangers have become popular in recent years. However, pinch grip hangers generally have greater depth than clip hangers, resulting in fewer garments per rod or per loop when shipping the garments, and a tendency to inadvertently drop the garments when subjected to unexpected shipping loads, as adjacent hangers impact one another and open one or more of the pinch grips. The pinch-grip hangers of the prior art are typically recycled after purchase of the garment thereon. The hangers are generally shipped in quantity in shipping containers. The cost of the original shipping of the hangers is a function of the weight and cube (volume) of the container. Because of the size and shape of the pinch-grip hangers of the prior art, the volume of the container is not used effectively to hold the hangers. This leads to increased shipping costs.

Inadvertent opening of the pinch grips can also occur in a retail store environment, as customers push the garments to one side to better view a garment of interest. Various guards have been proposed in the prior art to prevent the inadvertent opening of the pinch grips, but these guards further contribute to increased depth for the product.

SUMMARY OF THE INVENTION

Therefore it is an object of the present invention to provide a pinch-grip hanger capable of nesting in a stack of pinch-grip hangers.

It is another object of the present invention to provide a nestable pinch-grip hanger capable of nesting in a stack of pinch-grip hangers to reduce the shipping costs associated with pinch-grip type hangers.

Accordingly, a nestable hanger is provided. The nestable hanger comprising: a support means for supportably hanging the hanger on a display; a body supported by the support means and having two pinch grips disposed thereon for retaining a garment therein; and nesting means for nesting the hanger in a stack of similar hangers such that the hanger interlocks with the stack of similar hangers.

Preferably, the hanger is in a plane substantially parallel with a plane of the stack of similar hangers. The hanger can also be in substantially a same plane as the stack of similar hangers.

In a first alternative, the nesting means comprises: the support means comprises a hook; and the two pinch grips being equidistant from the hook on opposite ends of the body in a first direction, the pinch grips further being offset in a second direction orthogonal to the first direction by an amount equal to a thickness of at least a portion of a corresponding hook in the stack of similar hangers.

In another alternative, the nesting means comprises: the support means comprises a hook; and the body having a cut-out portion corresponding to at least a portion of a hook on the stack of similar hangers to accommodate the hook in the stack of similar hangers while nested together in the stack.

In still another alternative, the nesting means comprises the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a corresponding pocket of the similar hangers in the stack of hangers. In such configuration, the nestable hanger preferably further comprises means for preventing inadvertent actuation of the pinch ends while the garment is inserted between the pinch ends. In a first alternative, the means for preventing inadvertent actuation of the pinch ends comprises at least one guard member disposed on the actuation end of the first jaw, the at least one guard member projecting outwardly from the first jaw toward the actuation end of the second jaw such that an inadvertent actuation force is at least partially blocked from being applied to the actuation end of the second jaw. In a second alternative, the means for preventing inadvertent actuation of the pinch ends comprises at least one of the first and second jaws having a shape such that a widest portion of the pinch grip in a direction orthogonal to the axis of rotation is below the axis of rotation.

In a first configuration, the support means is preferably a hook integrally formed with the body. In such configuration, the nestable hanger preferably further comprises a size indicator disposed on a transition portion between the hook and the body. In an alternative configuration, the support means is a hook rotatably disposed in the body.

Also provided is a nestable hanger comprising: a hook for supportably hanging the hanger on a display; and a body supported by the hook and having two pinch grips disposed thereon for retaining a garment therein; wherein the two pinch grips being equidistant from the hook on opposite ends of the body in a first direction, the pinch grips further being offset in a second direction orthogonal to the first direction by an amount equal to a thickness of at least a portion of a corresponding hook in the stack of similar hangers for nesting the hanger in the stack of similar hangers such that the hanger interlocks with the stack of similar hangers.

Still provided is a nestable hanger comprising: a hook for supportably hanging the hanger on a display; and a body supported by the hook and having two pinch grips disposed thereon for retaining a garment therein; wherein the body having a cut-out portion corresponding to at least a portion of a hook on a stack of similar hangers to accommodate the hook in the stack of similar hangers while nested together in the stack.

Yet still provided is a nestable hanger comprising: a hook for supportably hanging the hanger on a display; and a body supported by the hook and having two pinch grips disposed thereon for retaining a garment therein; wherein the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a corresponding pocket of a similar hanger in a stack of hangers.

Still yet provided is a nestable hanger comprising: a support means for supportably hanging the hanger on a display; a body supported by the support means and having two pinch grips disposed thereon for retaining a garment therein; and nesting means for nesting the hanger in a stack of similar hangers such that the hanger interlocks with the stack of similar hangers, the nesting means comprising at least two of: the support means comprises a hook, and the two pinch grips being equidistant from the hook on opposite ends of the body in a first direction, the pinch grips further being offset in a second direction orthogonal to the first direction by an amount equal to a thickness of at least a portion of a corresponding hook in the stack of similar hangers; the support means comprises a hook, and the body having a cut-out portion corresponding to at least a portion of a hook on the stack of similar hangers to accommodate the hook in the stack of similar hangers while nested together in the stack; and the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a corresponding pocket of the similar hangers in the stack of hangers.

Still yet provided is a stack of hangers comprising: a plurality of nestable hangers, each individual hanger in the plurality of nestable hangers being nested with at least one other individual hanger in the plurality of hangers, each individual hanger comprising: a support means for supportably hanging the individual hanger on a display; a body supported by the support means and having two pinch grips disposed thereon for retaining a garment therein; and nesting means for nesting the individual hanger in the stack of hangers such that the individual hanger interlocks with a corresponding hanger in the stack of hangers.

Preferably, each of the individual hangers is in a plane substantially parallel with a plane of each of the other plurality of hangers in the stack of hangers. In a first alternative, each of the individual hangers is in substantially a same plane as each of the other plurality of hangers in the stack of hangers.

In a first alternative, the nesting means comprises: the support means comprises a hook; and the two pinch grips being equidistant from the hook on opposite ends of the body in a first direction, the pinch grips further being offset in a second direction orthogonal to the first direction by an amount equal to a thickness of at least a portion of a corresponding hook in the stack of hangers.

In a second alternative, the nesting means comprises: the support means comprises a hook; and the body having a cut-out portion corresponding to at least a portion of a corresponding hook on the stack of hangers.

In a third alternative, the nesting means comprises the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a corresponding pocket of the hangers in the stack of hangers.

Each of the individual hangers in the stack of hangers preferably further comprises means for preventing inadvertent actuation of the pinch ends while the garment is inserted between the pinch ends. In a first alternative, the means for preventing inadvertent actuation of the pinch ends comprises at least one guard member disposed on the actuation end of the first jaw, the at least one guard member projecting outwardly from the first jaw toward the actuation end of the second jaw such that an inadvertent actuation force is at least partially blocked from being applied to the actuation end of the second jaw. In a second alternative, the means for preventing inadvertent actuation of the pinch ends comprises at least one of the first and second jaws having a shape such that a widest portion of the pinch grip in a direction orthogonal to the axis of rotation is below the axis of rotation.

In a first configuration, the support means for each of the individual hooks in the plurality of hooks is preferably a hook integrally formed with the body. In such configuration, the stack of hangers preferably further comprise a size indicator disposed on a transition portion between the hook and the body on each of the individual hangers in the plurality of hangers. In another configuration, the support means for each of the individual hooks in the plurality of hangers is preferably a hook rotatably disposed in the body.

Still yet provided is a stack of hangers comprising: a plurality of nestable hangers, each individual hanger in the plurality of nestable hangers being nested with at least one other individual hanger in the plurality of hangers, each individual hanger comprising: a hook for supportably hanging the individual hanger on a display; and a body supported by the hook and having two pinch grips disposed thereon for retaining a garment therein; and wherein the two pinch grips being equidistant from the hook on opposite ends of the body in a first direction, the pinch grips further being offset in a second direction orthogonal to the first direction by an amount equal to a thickness of at least a portion of a corresponding hook in the stack of hangers for nesting the individual hanger in the stack of hangers such that the hanger interlocks with a corresponding hanger in the stack of hangers.

Still yet provided is a stack of hangers comprising: a plurality of nestable hangers, each individual hanger in the plurality of nestable hangers being nested with at least one other individual hanger in the plurality of hangers, each individual hanger comprising: a hook for supportably hanging the individual hanger on a display; and a body supported by the hook and having two pinch grips disposed thereon for retaining a garment therein; wherein the body having a cut-out portion corresponding to at least a portion of a hook disposed on the stack of hangers to accommodate the hook in the stack of hangers while nested together in the stack.

Still yet provided is a stack of hangers comprising: a plurality of nestable hangers, each individual hanger in the plurality of nestable hangers being nested with at least one other individual hanger in the plurality of hangers, each individual hanger comprising: a hook for supportably hanging the individual hanger on a display; and a body supported by the hook and having two pinch grips disposed thereon for retaining a garment therein; wherein the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a corresponding pocket of a hanger in the stack of hangers.

Still yet provided is a stack of hangers comprising: a plurality of nestable hangers, each individual hanger in the plurality of nestable hangers being nested with at least one other individual hanger in the plurality of hangers, each individual hanger comprising: a support means for supportably hanging the individual hanger on a display; a body supported by the support means and having two pinch grips disposed thereon for retaining a garment therein; and nesting means for nesting the individual hanger in the stack of hangers such that the individual hanger interlocks with a corresponding hanger in the stack of hangers, the nesting means comprising at least two of: the support means comprises a hook, and the two pinch grips being equidistant from the hook on opposite ends of the body in a first direction, the pinch grips further being offset in a second direction orthogonal to the first direction by an amount equal to a thickness of at least a portion of a corresponding hook in the stack of hangers; the support means comprises a hook, and the body having a cut-out portion corresponding to at least a portion of a hook disposed on the stack of hangers to accommodate the hook from a corresponding hanger in the stack of hangers while nested together in the stack; and the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a pocket of a corresponding hanger in the stack of hangers.

Still yet provided is a container of hangers. The container comprising: walls defining an interior; and a plurality of stacks of hangers disposed in the interior, each of the individual stacks of hangers comprising a plurality of nestable hangers, each individual hanger in the plurality of nestable hangers being nested with at least one other individual hanger in the plurality of hangers, each individual hanger comprising: a support means for supportably hanging the individual hanger on a display; a body supported by the support means and having two pinch grips disposed thereon for retaining a garment therein; and nesting means for nesting the individual hanger in the stack of hangers such that the individual hanger interlocks with a corresponding hanger in the stack of hangers.

In a first alternative, each of the individual hangers is in a plane substantially parallel with a plane of each of the other plurality of hangers in the stack of hangers. In another alternative, each of the individual hangers is in substantially a same plane as each of the other plurality of hangers in the stack of hangers.

In a first alternative, the nesting means comprises: the support means comprises a hook; and the two pinch grips being equidistant from the hook on opposite ends of the body in a first direction, the pinch grips further being offset in a second direction orthogonal to the first direction by an amount equal to a thickness of at least a portion of a corresponding hook in the stack of hangers.

In a second alternative, the nesting means comprises: the support means comprises a hook; and the body having a cut-out portion corresponding to at least a portion of a corresponding hook on the stack of hangers.

In a third alternative, the nesting means comprises the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a corresponding pocket of the hangers in the stack of hangers.

Preferably, each of the individual hangers further comprises means for preventing inadvertent actuation of the pinch ends while the garment is inserted between the pinch ends. In a first alternative, the means for preventing inadvertent actuation of the pinch ends comprises at least one guard member disposed on the actuation end of the first jaw, the at least one guard member projecting outwardly from the first jaw toward the actuation end of the second jaw such that an inadvertent actuation force is at least partially blocked from being applied to the actuation end of the second jaw. In another alternative, the means for preventing inadvertent actuation of the pinch ends comprises at least one of the first and second jaws having a shape such that a widest portion of the pinch grip in a direction orthogonal to the axis of rotation is below the axis of rotation.

In a first configuration, the support means for each of the individual hooks in the plurality of hooks is a hook integrally formed with the body. In such configuration, the container of hangers preferably further comprise a size indicator disposed on a transition portion between the hook and the body on each of the individual hangers in the plurality of hangers. In another configuration, the support means for each of the individual hooks in the plurality of hangers is a hook rotatably disposed in the body.

Still yet provided is a container of hangers, the container comprising: walls defining an interior; and a plurality of stacks of hangers disposed in the interior, each of the individual stacks of hangers comprising a plurality of nestable hangers, each individual hanger in the plurality of nestable hangers being nested with at least one other individual hanger in the plurality of hangers, each individual hanger comprising: a hook for supportably hanging the individual hanger on a display; and a body supported by the hook and having two pinch grips disposed thereon for retaining a garment therein; and wherein the two pinch grips being equidistant from the hook on opposite ends of the body in a first direction, the pinch grips further being offset in a second direction orthogonal to the first direction by an amount equal to a thickness of at least a portion of a corresponding hook in the stack of hangers for nesting the individual hanger in the stack of hangers such that the hanger interlocks with a corresponding hanger in the stack of hangers.

Still yet provided is a container of hangers, the container comprising: walls defining an interior; and a plurality of stacks of hangers disposed in the interior, each of the individual stacks of hangers comprising a plurality of nestable hangers, each individual hanger in the plurality of nestable hangers being nested with at least one other individual hanger in the plurality of hangers, each individual hanger comprising: a hook for supportably hanging the individual hanger on a display; and a body supported by the hook and having two pinch grips disposed thereon for retaining a garment therein; wherein the body having a cut-out portion corresponding to at least a portion of a hook disposed on the stack of hangers to accommodate the hook in the stack of hangers while nested together in the stack.

Still yet provided is a container of hangers, the container comprising: walls defining an interior; and a plurality of stacks of hangers disposed in the interior, each of the individual stacks of hangers comprising a plurality of nestable hangers, each individual hanger in the plurality of nestable hangers being nested with at least one other individual hanger in the plurality of hangers, each individual hanger comprising: a hook for supportably hanging the individual hanger on a display; and a body supported by the hook and having two pinch grips disposed thereon for retaining a garment therein; wherein the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a corresponding pocket of a hanger in the stack of hangers.

Still yet provided is a container of hangers, the container comprising: walls defining an interior; and a plurality of stacks of hangers disposed in the interior, each of the individual stacks of hangers comprising a plurality of nestable hangers, each individual hanger in the plurality of nestable hangers being nested with at least one other individual hanger in the plurality of hangers, each individual hanger comprising: a support means for supportably hanging the individual hanger on a display; a body supported by the support means and having two pinch grips disposed thereon for retaining a garment therein; and nesting means for nesting the individual hanger in the stack of hangers such that the individual hanger interlocks with a corresponding hanger in the stack of hangers, the nesting means comprising at least two of: the support means comprises a hook, and the two pinch grips being equidistant from the hook on opposite ends of the body in a first direction, the pinch grips further being offset in a second direction orthogonal to the first direction by an amount equal to a thickness of at least a portion of a corresponding hook in the stack of hangers; the support means comprises a hook, and the body having a cut-out portion corresponding to at least a portion of a hook disposed on the stack of hangers to accommodate the hook from a corresponding hanger in the stack of hangers while nested together in the stack; and the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a pocket of a corresponding hanger in the stack of hangers.

Still yet provided is a method for transporting hangers. The method comprising: providing a nestable pinch-grip hanger; nesting a plurality of the nestable pinch-grip hangers into at least one stack of hangers; and transporting the at least one stack of hangers between destinations.

Preferably, the at least one stack of hangers comprises a plurality of stacks of hangers, wherein the transporting further comprises stacking the plurality of stacks of hangers in a shipping container and transporting the shipping container between the destinations.

Still yet provided is a method for handling hangers, the method comprising: providing a nestable pinch-grip hanger; nesting a plurality of the nestable pinch-grip hangers into at least one stack of hangers; feeding the at least one stack of hangers into a processing station of an automated hanger processing apparatus; and processing each of the plurality of nestable pinch-grip hangers in the at least one stack of hangers.

Preferably, the processing comprises inserting a garment on each of the plurality of nestable pinch-grip hangers in the at least one stack of hangers. Alternatively, the processing comprises inserting a size indicator on each of the plurality of nestable pinch-grip hangers in the at least one stack of hangers.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Figure 1A:
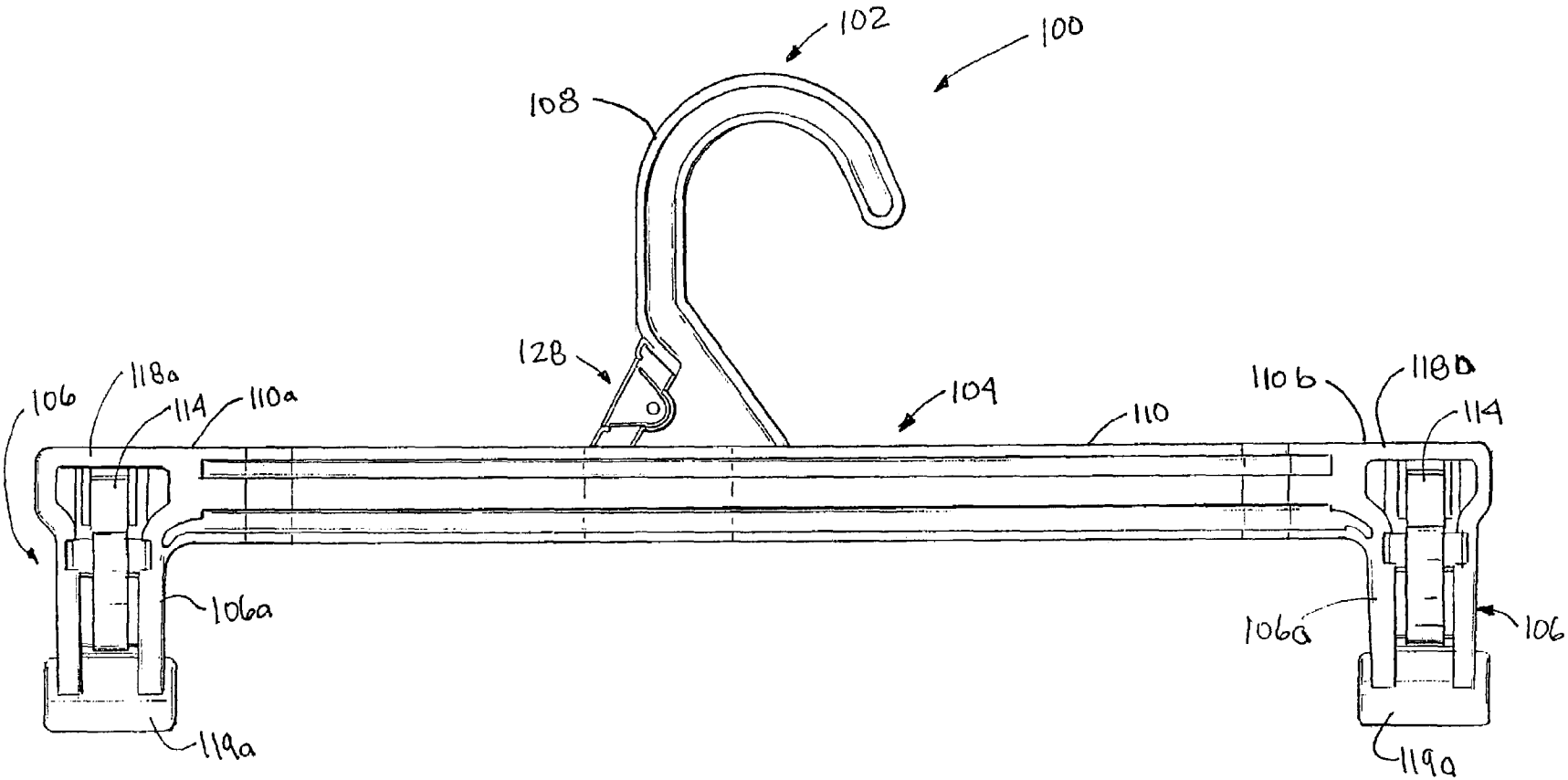
FIG. 1A illustrates a back view of a preferred implementation of a nestable pinch-grip hanger having an integrally molded hook member.

Preferred implementations of the improved pinch grip hanger of the present invention are illustrated in FIGS. 1A–1C and 2A–2C and referred to generally by reference numerals 100 and 200, respectively. The improved pinch grip hanger 100, 200 is molded of plastic with a support means 102, 202 for supportably hanging the hanger on a display. The hanger further has a body 104, 204 supported by the support means 102, 202. The body 104, 204 has two pinch grips 106, 206 disposed thereon for retaining a garment. As will be described below, the hanger 100, 200 includes nesting means for nesting the hanger in a stack of similar hangers such that the hanger interlocks with the stack of similar hangers. For purposes of this disclosure, "interlocks" means that the relative motion between hangers in the stack is restricted by some degree. Although, the degree of restriction may require an applied force to separate the hangers from one another, such an applied force is not necessary. For example, in the preferred implementation discussed below, the nestable hangers in the stack can be separated easily from one another, however, each hanger is shaped and/or configured to "fit" or nest with at least one other hanger in the stack analogous to the nesting of outdoor resin chairs. Furthermore, the nestable hanger preferably nests in a plane substantially parallel with a plane of the stack of similar hangers and more preferably in substantially a same plane as the stack of similar hangers. For the purpose of this disclosure, nesting of a hanger in a plane substantially parallel with a plane of the stack of similar hangers where the planes are not the same plane will be referred to as vertical nesting, while nesting of a hanger in a plane substantially parallel with a plane of the stack of similar hangers where the planes are the same plane will be referred to as horizontal nesting. Although, the nestable hanger is described and shown herein in a horizontal nesting configuration, such is done by way of example only and not to limit the spirit or scope of the present invention.

Figure 1B:
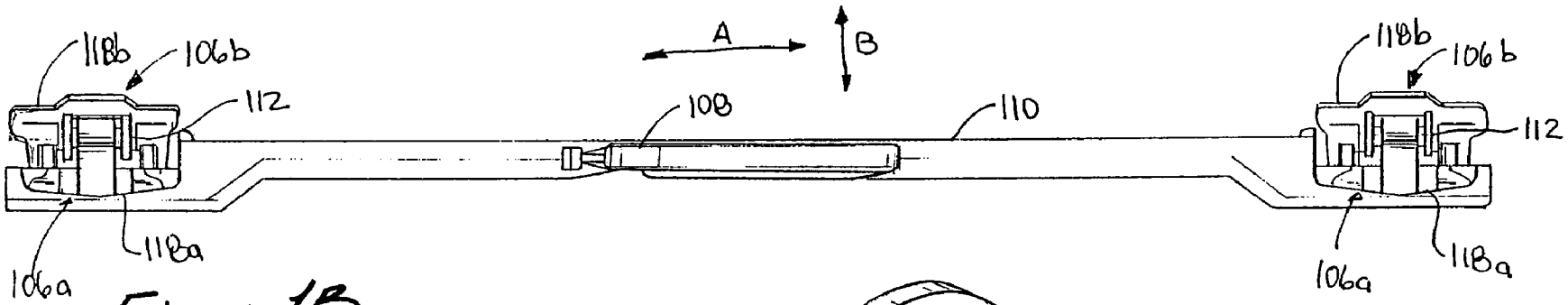
FIG. 1B illustrates a top view of the nestable pinch-grip hanger of FIG. 1A.
Figure 1C:
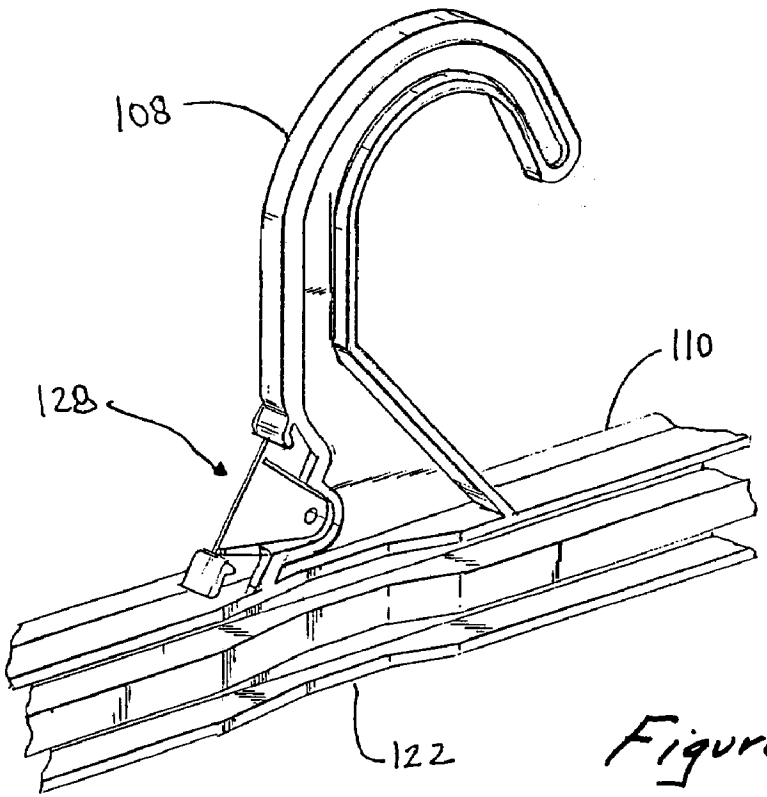
FIG. 1C illustrates a partial isometric view of the nestable pinch-grip hanger of FIG. 1A.
Figure 2A:
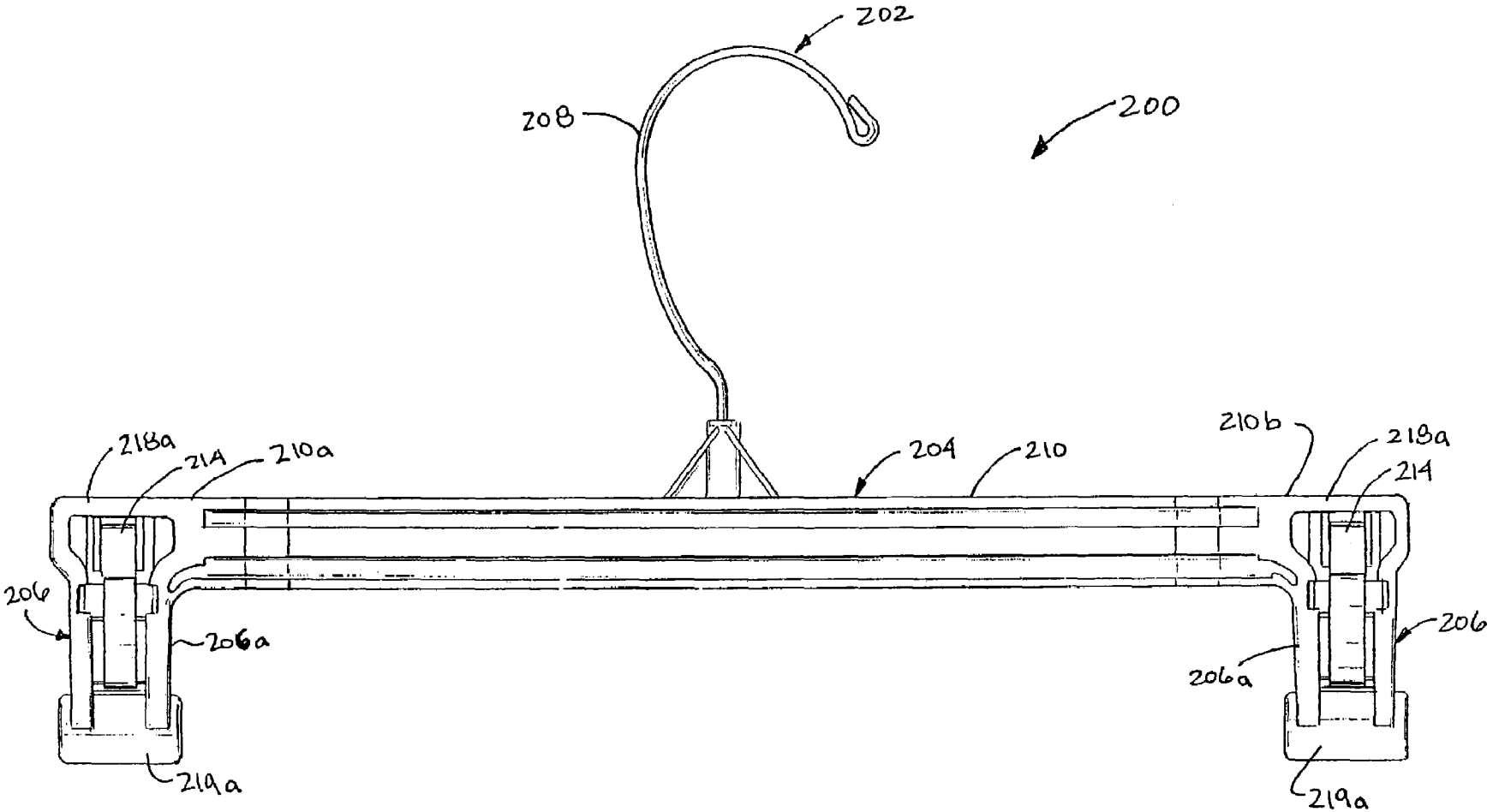
FIG. 2A illustrates a front view of a preferred implementation of a nestable pinch-grip hanger having a metal wire hook member rotatably disposed in the body of the hanger.
Figures 2B, 2C:
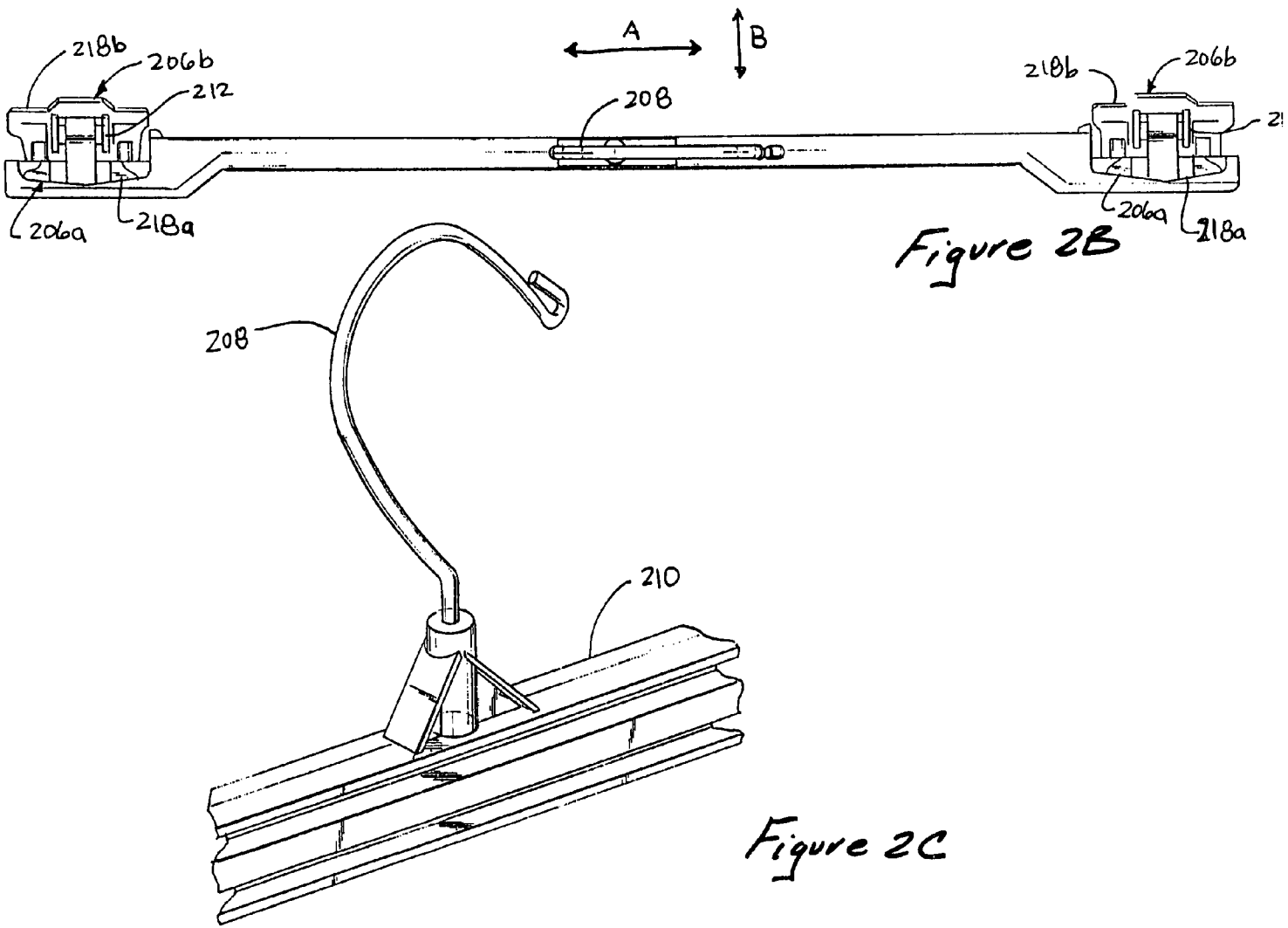
FIG. 2B illustrates a top view of the nestable pinch-grip hanger of FIG. 2A.
FIG. 2C illustrates a partial isometric view of the nestable pinch-grip hanger of FIG. 2A.

In the hanger of FIGS. 1A–1C, the support means is an upwardly extended hook member 108 formed of plastic and integrally molded with the body 104. As illustrated in FIGS. 2A–2C, an alternative hanger 200 is shown therein in which the hanger is fitted with a wire metal hook 208 that is swivel mounted in the body 204 in a manner well known in the art. The hook member 108 can include an upstanding flange member (not shown) that is adapted to receive a size indicia (not shown) for a characteristic of the garment suspended in the hanger, such as a size indicator permanently affixed to the hook member 108 as taught by U.S. Pat. No. 5,604,975 or the size indicator releasably secured to the hook member 108 as taught by U.S. Pat. No. 5,794,363. Both of these patents are assigned to the assignee of the present invention, and the disclosures of both patents are incorporated herein by reference thereto.

As discussed more fully below and illustrated in FIGS. 1A–1C, the present invention may also be fitted with a pivoting flange to receive a side sizer in the matter taught in U.S. Pat. No. 6,260,745, also assigned to the assignee of the present invention. The disclosure of this patent is also incorporated herein by reference thereto. Preferably, such a side sizer is disposed on a transition portion between the hook member 108 and the body 104 of the hanger 100.

As illustrated in FIGS. 1A–1C and 2A–2C, the body 104, 204 of the pinch grip hanger is a horizontally extending support bar 110, 210. The support bar 110, 210 includes the pinch grips 106 positioned on either end 110*a*, 110*b*, 210*a*, 210*b* of the support bar 110, 210. Although many different shape cross-sections are possible, the central support bar 110, 210 is preferably formed of a square M-shaped cross-section that provides exceptional strength along the vertical axis of the hanger. Each of the pinch grips 106, 206 include first and second pinch grip jaws 106*a*, 106*b*, 206*a*, 206*b* with the first jaw members 106*a*, 206*a* being integrally molded with the support bar 104, 204. The second jaw members 106*b*, 206*b* are pivotally secured to the first jaw members 106*a*, 206*a* at a pivot mounting 112, 212, by a spring member 114, 214, as will be hereinafter discussed in detail. Each of the pinch grip jaws 106*a*, 106*b*, 206*a*, 206*b* define garment-engaging areas 116, 216. Each of the moveable first and second jaw members 106*a* 106*b*, 206*a* 206*b* also have an actuation end 118*a*, 118*b*, 218*a*, 218*b* used to open the pinch grip 106, 206 and pinch ends 119*a*, 119*b*, 219*a*, 219*b*. Each of the first and second jaw members 106*a*, 106*b*, 206*a*,

206*b* are molded with teeth 120, where the teeth 120, are preferably staggered so that they do not directly oppose each other. Alternatively, each of the first and second jaw members 106*a*, 106*b*, 206*a*, 206*b* are fitted with a molded non-slip pad (not shown). Thus, the pinch ends 119*a*, 119*b*, 219*a*, 219*b* are biased together by the spring member 114, 214 and are actuated apart by an actuation force applied at the actuation ends 118*a*, 118*b*, 218*a*, 218*b*.

Figure 5A:
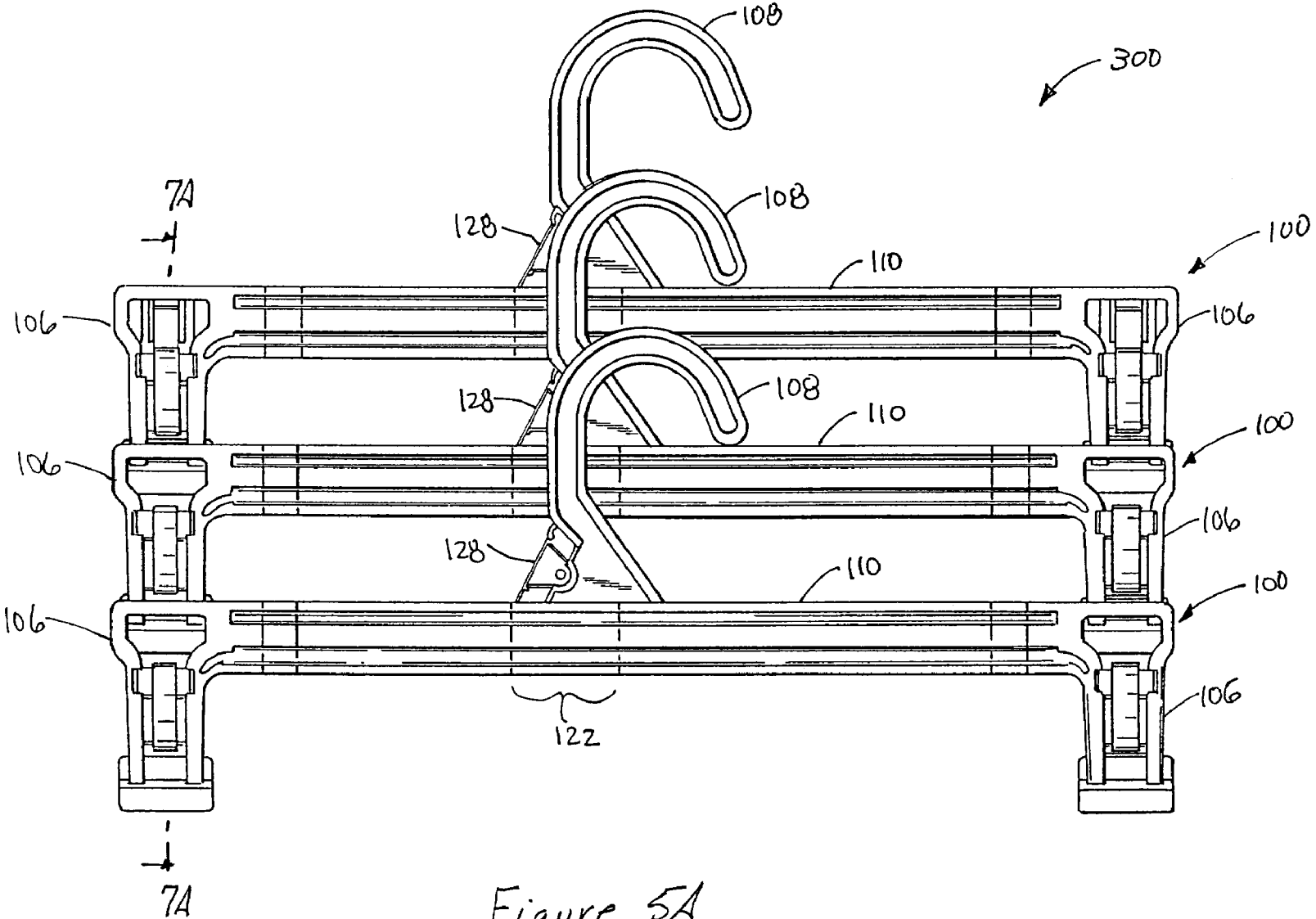
FIG. 5A illustrates a front view of a stack of the nestable hangers as shown in FIG. 1A.
Figure 5B:
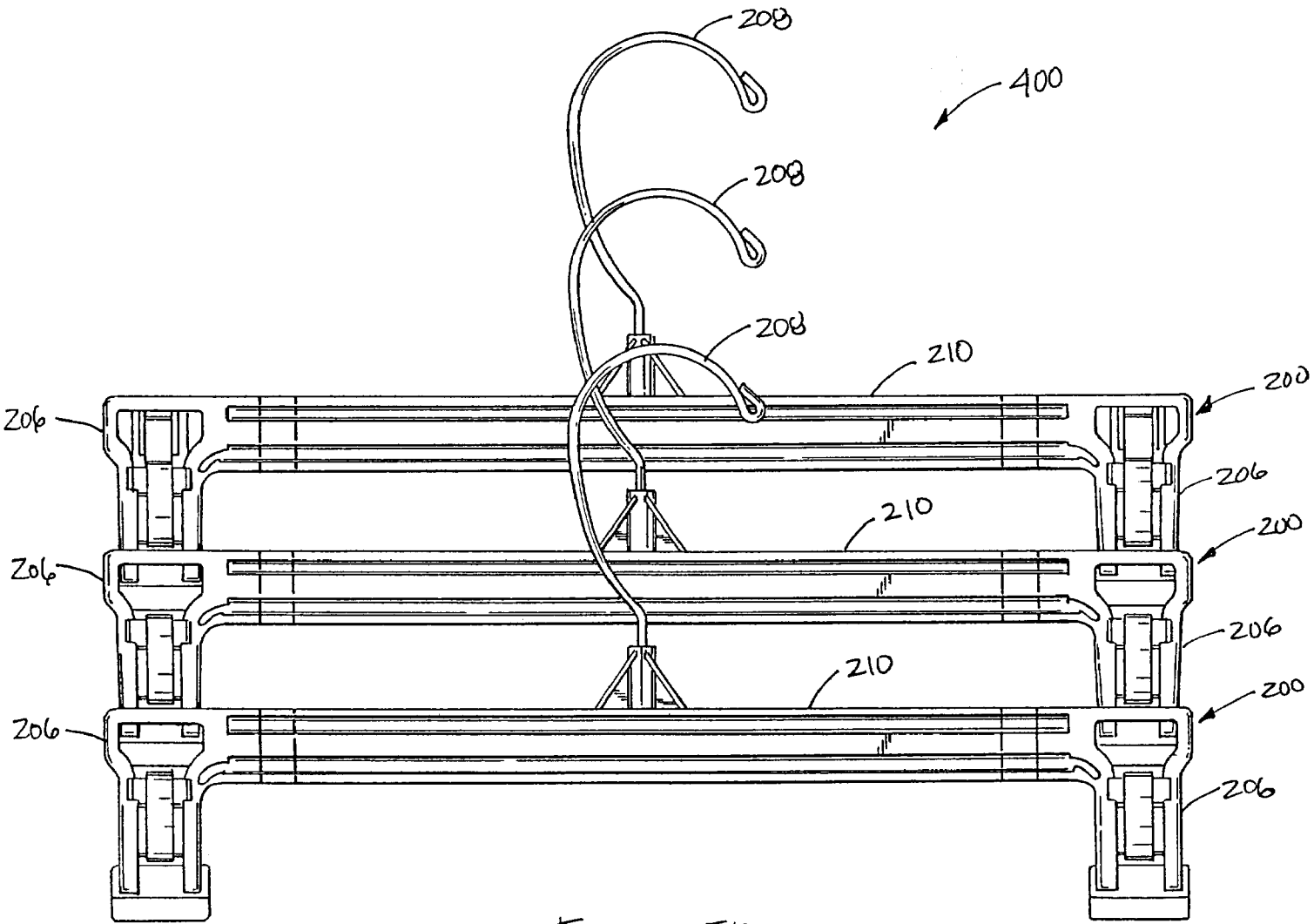
FIG. 5B illustrates a front view of a stack of the nestable hangers as shown in FIG. 2A.

Referring now to FIGS. 5A and 5B, there is shown stacks of hangers 100, 200, generally referred to by reference numerals 300, 400, respectively. As discussed above, although the hangers 100, 200 can be nested in either a horizontal or vertical nesting configuration, the horizontal configuration is shown by way of example only and not to limit the spirit or scope of the present invention. Furthermore, although the nests 300, 400 of hangers 100, 200 are shown with three individual hangers 100, 200 in the nest 300, 400, those skilled in the art will appreciate that any number of individual hangers 100, 200 greater than two can be nested without departing from the spirit or scope of the present invention. Still further, the nesting of hangers 100, 200 will be described and shown in FIGS. 6 and 7A with more specificity with regard to hangers 100. Unless otherwise noted, the nesting of hangers 200 is similarly configured to that shown and described with regard to hangers 100.

Figure 6:
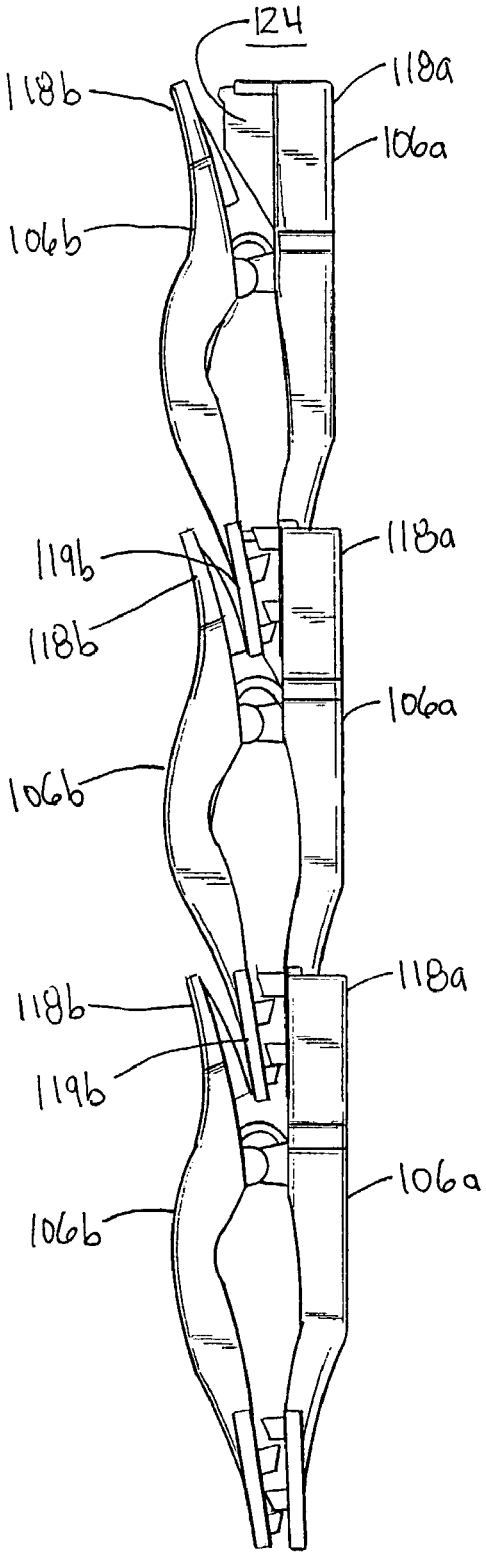
FIG. 6 illustrates a side view of the stack of nestable hangers of FIG. 5A.
Figure 7A:
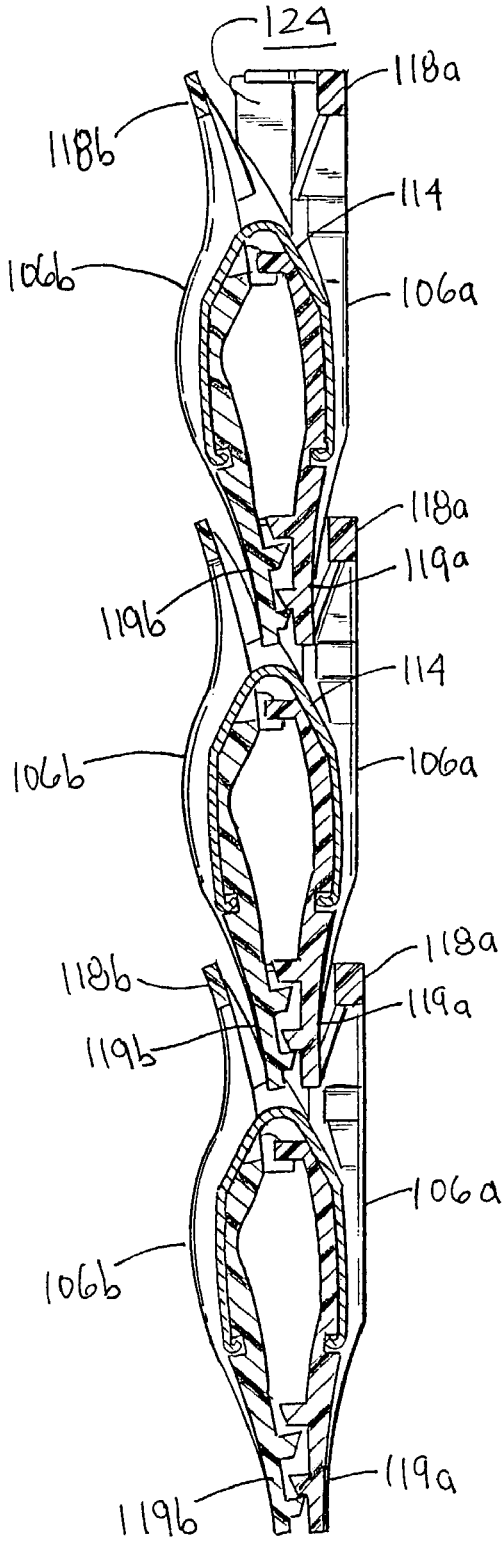
FIG. 7A illustrates a sectional view of the stack of nestable hangers of FIG. 5A as taken along line 7A—7A in FIG. 5A.

Referring now to FIGS. 6 and 7A, the nesting means can comprise the actuatable ends 118*a*, 118*b*, 218*a*, 218*b* defining a pocket 124 having a shape and size larger than a size and shape of the pinch ends 119*a*, 119*b*, 219*a*, 219*b* such that the pinch ends 119*a*, 119*b*, 219*a*, 219*b* are accommodated into a corresponding pocket 124 of the individual hangers 100, 200 in the stack of hangers 300, 400. The pocket 124 preferably accommodates enough of the pinch ends 119*a*, 119*b*, 219*a*, 219*b* to provide a stable stack of nesting hangers 300, 400. However, those skilled in the art will appreciate that the pinch ends 119*a*, 119*b*, 219*a*, 219*b* need not positively lock into the pocket 124, such as by a press fit or interference with a protrusion in the pocket 124, it is sufficient that the pinch ends 119*a*, 119*b*, 219*a*, 219*b* be loosely secured in the pocket 124.

Referring now to FIGS. 1B and 2B, the nesting means can also comprise alone or in addition to that described above, the pinch grips 106, 206 being equidistant from the hook 108, 208 on opposite ends of the body 104, 204 in a first direction (indicated by arrow A) and the pinch grips 106, 206 further being offset in a second direction (indicated by arrow B) orthogonal to the first direction by an amount equal to a thickness of at least a portion of a corresponding hook member 104, 204 in the stack of individual similar hangers 300, 400. Preferably the amount of offset in the direction of arrow B is substantially equal to the thickness of the corresponding hook member 104, 204. As shown in FIGS. 5A and 5B the offset facilitates nesting of the hangers 100, 200 in the horizontal stacking configuration.

Figure 7B:
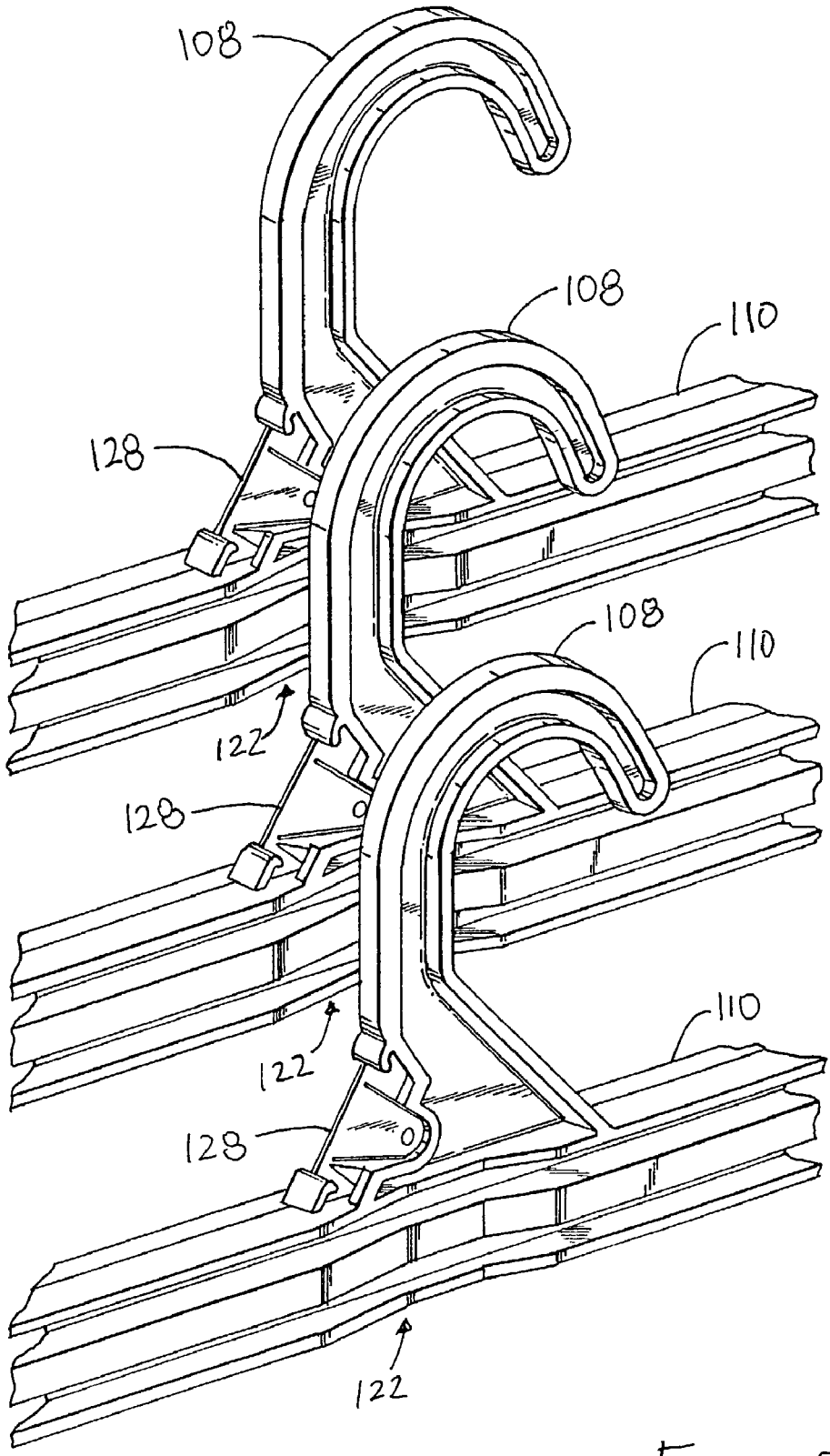
FIG. 7B illustrates a partial isometric view of the stack of nestable hangers of FIG. 5A.

Referring now to FIGS. 1C, 5A and 7B where the support means comprises the integrally formed hook member 108 the nesting means can also include alone or in combination with that described above, the body 104, 204 having a cut-out portion 122 corresponding to at least a portion of the hook member 104 on the stack of similar hangers 300, 400 to accommodate the hook member 104 in the stack of similar hangers 300, 400 while nested together in the stack.

Figure 3:
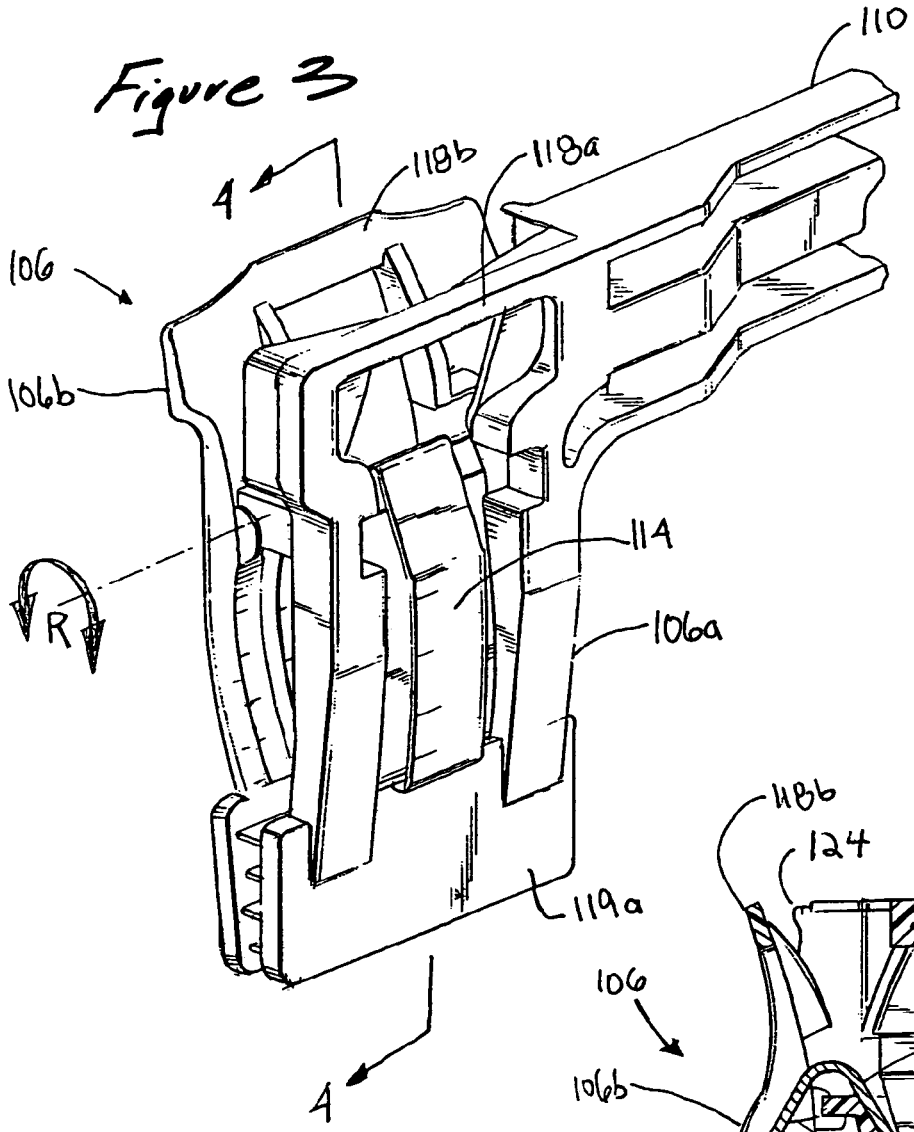
FIG. 3 illustrates a partial isometric view of one of the pinch-grips of the hanger of FIG. 1A.
Figure 4:
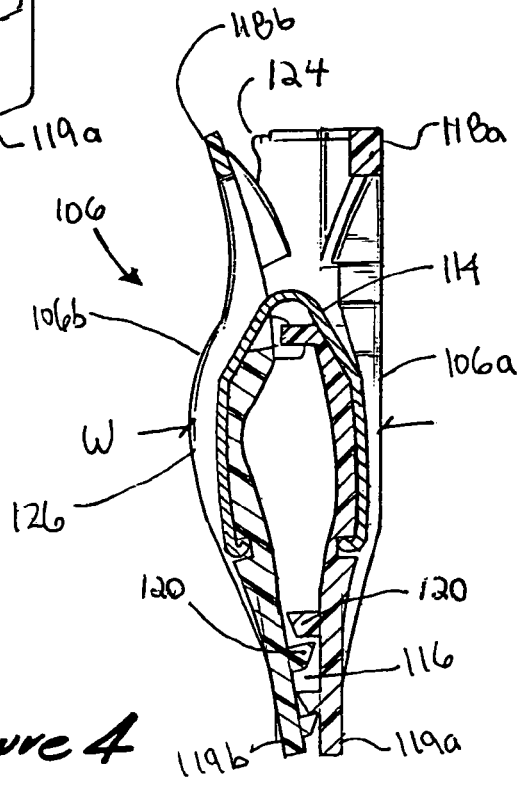
FIG. 4 illustrates a sectional view of the pinch grip of FIG. 3 as taken along line 4—4 in FIG. 3.

Referring now to FIGS. 3 and 4, the hangers 100, 200 further comprise means for preventing inadvertent actuation of the pinch ends 119*a*, 119*b*, 219*a*, 219*b* while a garment is inserted between the pinch ends 119*a*, 119*b*, 219*a*, 219*b*. The means for preventing inadvertent actuation of the pinch ends 119*a*, 119*b*, 219*a*, 219*b* can comprise at least one guard member 124 disposed on the actuation end 118*a*, 218*a*, of the first jaw 106*a*, 206*a*. The at least one guard member 124 projects outwardly from the first jaw 106*a*, 206*a* towards the actuation end 118*b*, 218*b* of the second jaw 106*b*, 206*b* such that an inadvertent actuation force F is at least partially blocked from being applied to the actuation end 118*b*, 218*b* of the second jaw 106*b*, 206*b*. The means for preventing inadvertent actuation of the pinch ends 119*a*, 119*b*, 219*a*, 219*b* can also comprise, alone or in combination with that described above, at least one of the first and second jaws 106*a*, 206*a*, 106*b*, 206*b* having a shape such that a widest portion W of the pinch grip 106, 206 in a direction orthogonal to the axis of rotation R is below the axis of rotation R. FIG. 4 illustrates the widest portion W of the pinch grip 106, 206 being due to a convexly curved portion 126 formed on the second jaw 106*b*, 206*b*. Thus, any object which is pressed against the second jaw 106*b*, 206*b* will likely be applied against the convexly curved portion 126 and will tend to keep the first and second jaws 106*a*, 206*a*, 106*b*, 206*b* closed rather than tend to open the jaws.

Figure 8:
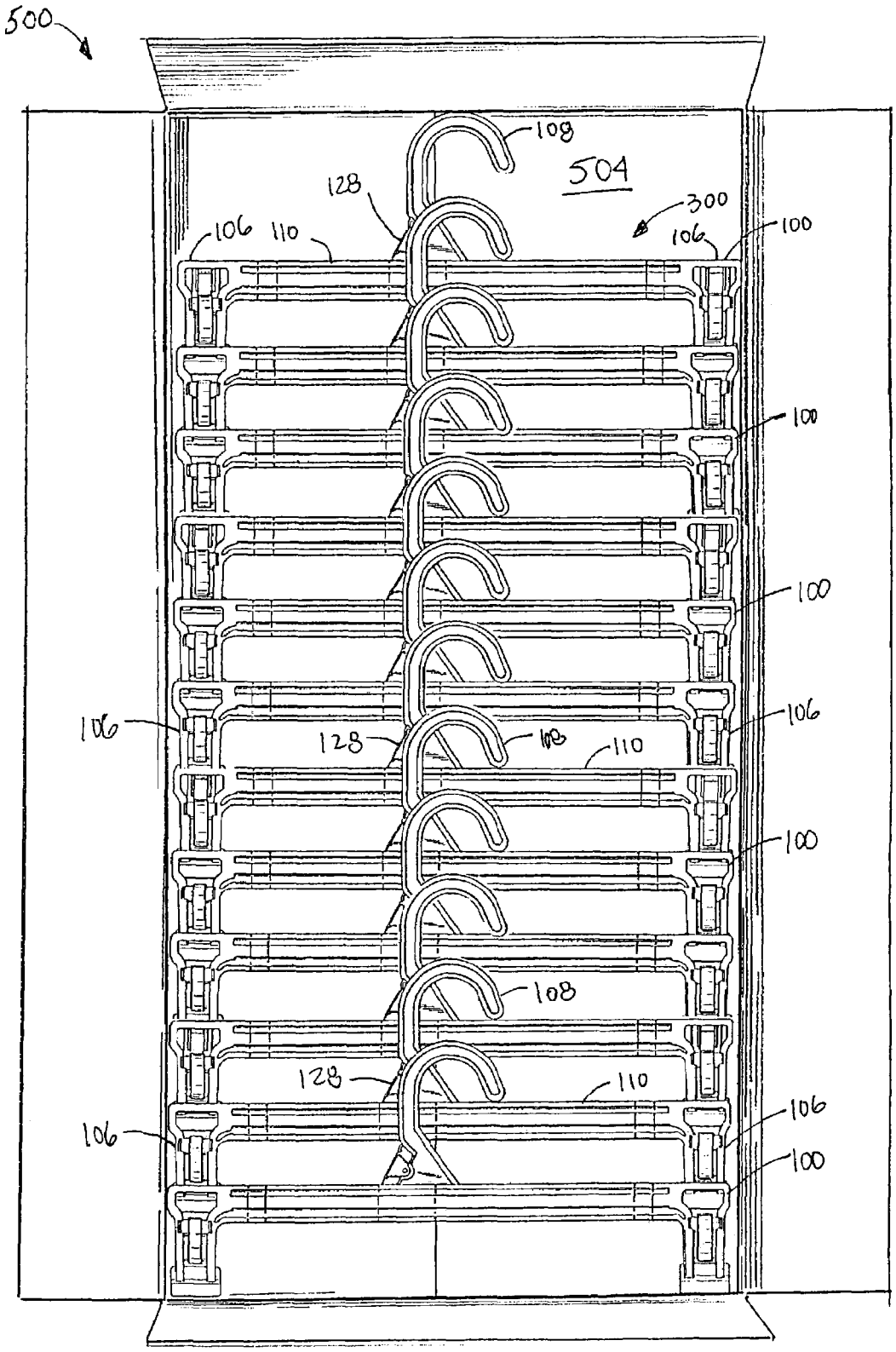
FIG. 8 illustrates a top view of a shipping container having a plurality of the stacks of nestable hangers of FIG. 5A.
Figure 9:
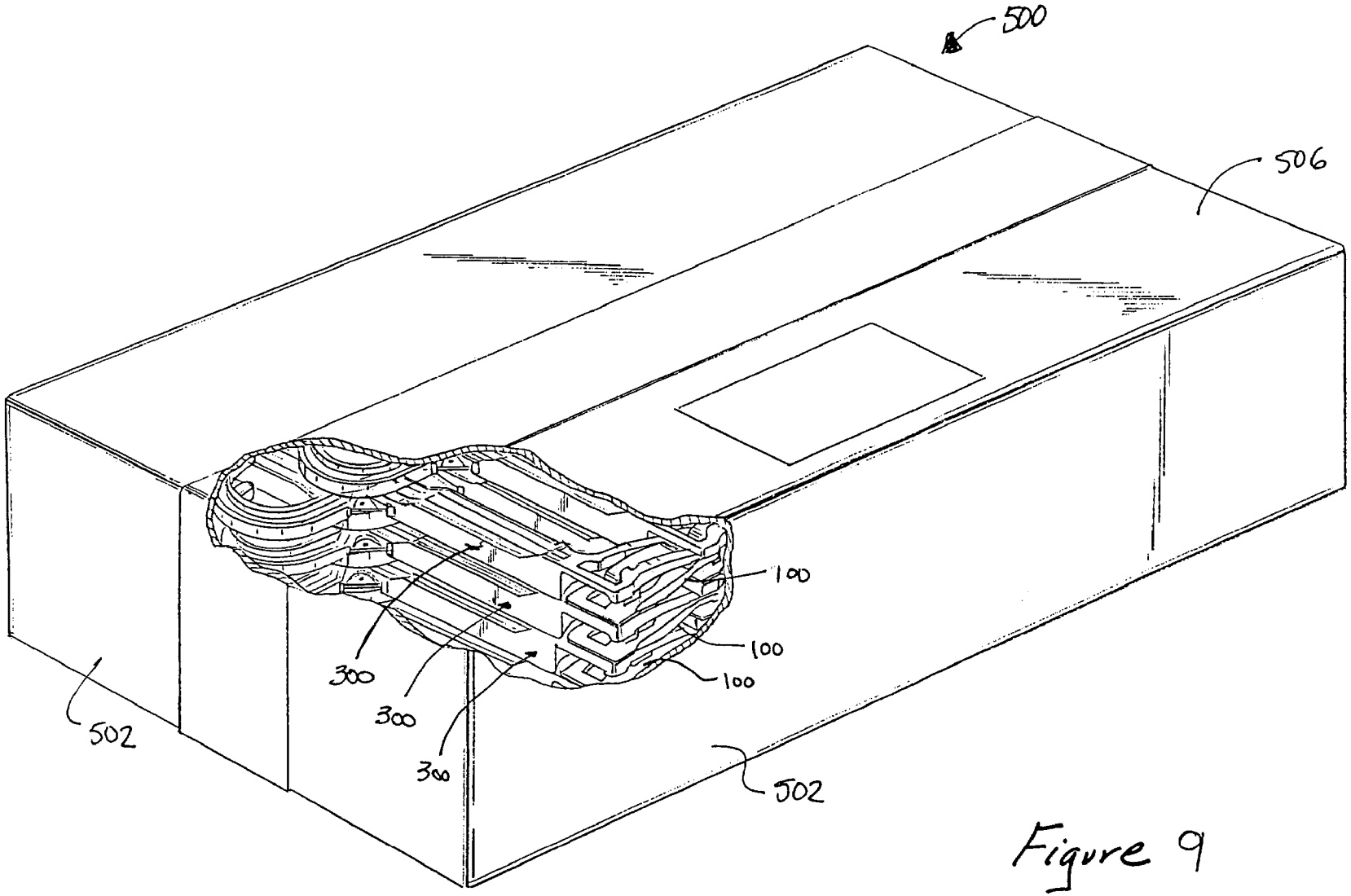
FIG. 9 illustrates an isometric view of the shipping container of FIG. 8 having a cut-away portion showing the stacks of nestable hangers therein.

Referring now to FIGS. 8 and 9, therein is illustrated a container of hangers, the container being generally referred to by reference numeral 500. Although, the container is shown having hangers 100 disposed therein, those skilled in the art will appreciate that hangers 200 can also be disposed therein without departing from the scope or spirit of the present invention. Generally, the container 500 is a shipping container and has walls 502 (including a bottom) defining an interior 504. The container can have a top 506 or be open at the top. Furthermore, the container 500 can be fabricated from numerous materials known in the art for shipping containers, such as cardboard, or plastic. A plurality of stacks of hangers 300 are disposed in the interior 504 where each of the individual stacks of hangers 300 comprise a plurality of nestable hangers 100 as described above. Although, the stacks of hangers 300 are shown having 12 individual hangers 100 in a horizontal nesting configuration, those skilled in the art will appreciate that any number of individual hangers greater than one in either a horizontal or vertical nesting configuration may be disposed in the container 500 without departing from the scope or spirit of the present invention. Furthermore, although the container 500 is shown having several stacks of hangers 300 disposed therein, those skilled in the art will appreciate that any number of stacks of hangers 300 greater than one can be disposed in the container 500 without departing from the scope or spirit of the present invention.

Those skilled in the art will appreciate that the novel nesting hangers 100, 200 and nesting stacks thereof 300, 400 provide for greater shipping density than would be possible with pinch-grip hangers of the prior art which are loosely packaged in containers. Those skilled in the art will also appreciate that the nesting means, particularly due to the offset and cut-out discussed above, also provide for greater display density when garments are disposed thereon and the hangers are hung from a display. Furthermore, the means for preventing inadvertent actuation discussed above, provides means for inadvertent actuation of the pinch grips 106, 206 when a garment is retained by the pinch grips 106, 206 when the hangers 100, 200 are both hung from a display and while being transported with the garments retained thereon.

Figure 11B:
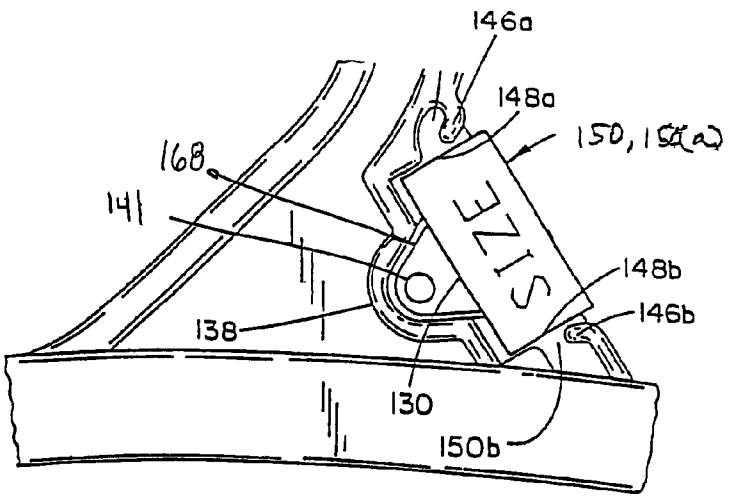
FIG. 11B illustrates the enlarged view of the web of FIG. 11A with a size indicator secured thereon.
Figure 11A:
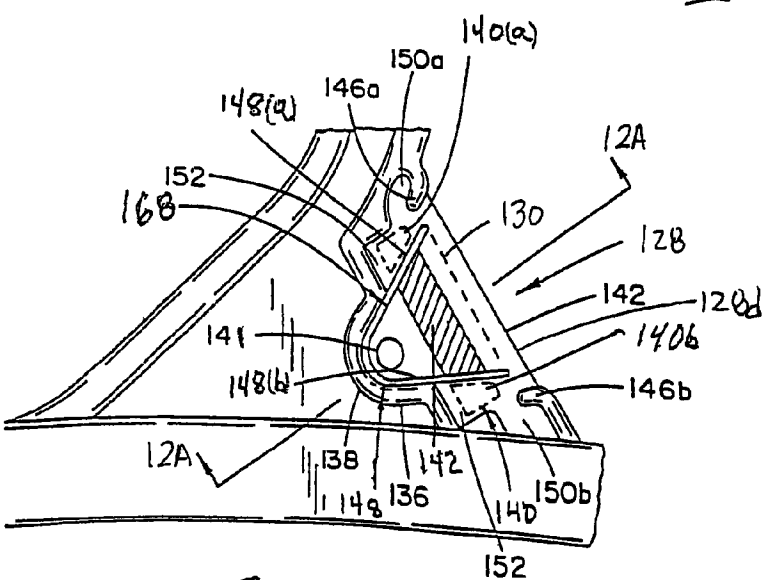
FIG. 11A illustrates an enlarged view of the first web of FIG. 1A.
Figure 12A:
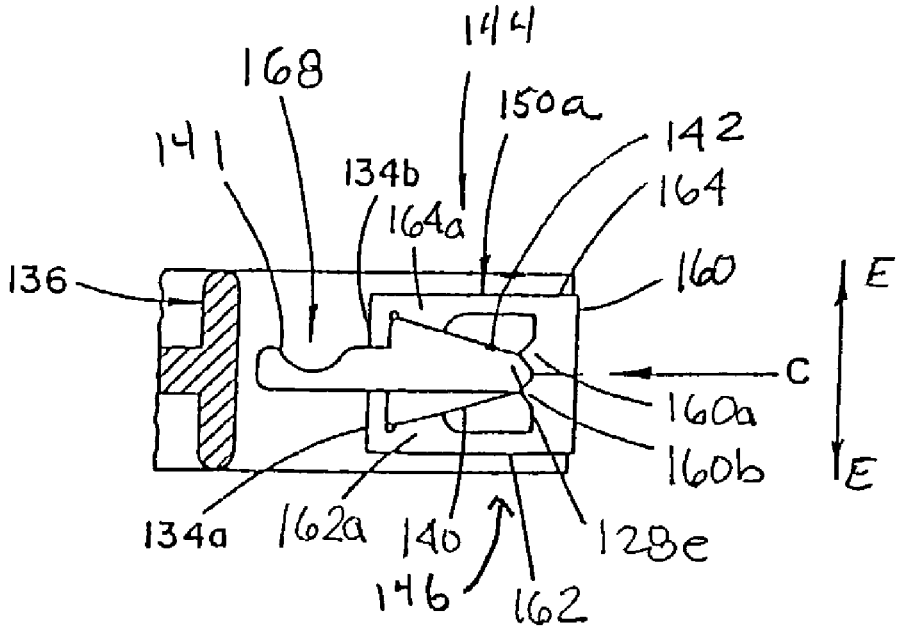
FIG. 12A illustrates a partial sectional view of the web of FIG. 11A as taken along line 12A—12A thereof and additionally having the second version of the size indicator secured thereon.
Figure 12B:
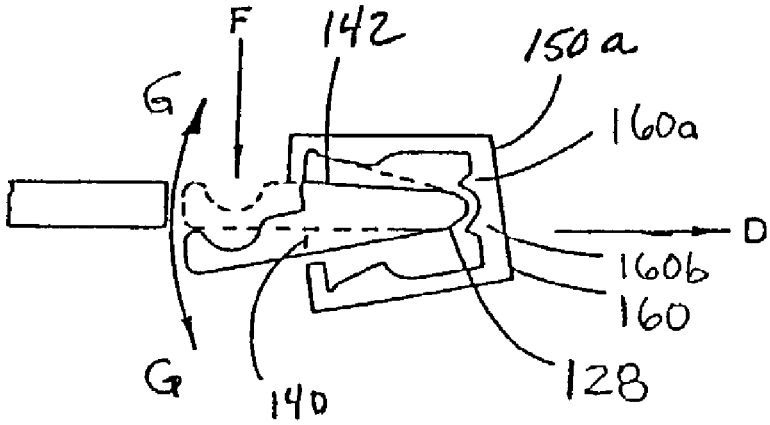
FIG. 12B illustrates the first web and the size indicator of FIG. 12A wherein the pivoting latch is being pivoted to release the size indicator therefrom.

Referring now to FIG. 11*a*, the hanger 100 preferably has a web 128 having a fixed latch 140 and a pivoting latch 142. The pivoting latch 142 is preferably located at a central portion of the web 128 and the fixed latch 140 is located on at least one end of the pivoting latch 142. Preferably, the fixed latch 140, as shown in FIG. 11*a*, comprises two abutments 140*a*, 140*b* located on each end of the pivoting latch 142. As illustrated in FIGS. 12*a* and 12*b*, it is also preferable that the pivoting latch 142 projects from a first side 144 of the web 128 and the fixed latch 140 projects from an opposite side 146 of the web 128.

Referring back to FIG. 11*a*, the pivoting latch 142 is preferably defined by a slot 148 cut through the web 128. The slot preferably has a shape defined by at least two sides 148*a*, 148*b*. The pivoting latch 142 is further defined by a living hinge, shown by dotted line 130 closing the shape of the slot 148. As shown in FIG. 11*a*, the slot 148 is preferably substantially two sided 148*a*, 148*b* and the living hinge 130 closes the shape of the slot 148 thereby forming a triangular shaped pivoting latch 142.

Referring now to FIGS. 11*a*, 11*b*, and 11*a* in combination, the pivoting latch 142 preferably has an engagement means for facilitating movement of the pivoting latch about arrow A shown in FIGS. 11*b*. The engagement means preferably comprises a cantilevered end 122 of the pivoting latch 142 which when a releasing force (FR) is applied thereto provides a mechanical advantage for movement of the pivoting latch 142 out of engagement with the size indicator. Simultaneously, the opposite side of the pivoting latch 142 displaces the size indicator such that it no longer engages the fixed latch 140.

Figure 10C:
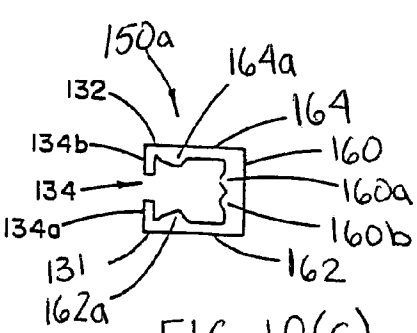
FIGS. 10A and 10C illustrate an end view of a first and second version, respectively, of a first embodiment of a size indicator of the present invention for engaging the first web of the hanger illustrated in Figure. 1A.
Figure 10B:
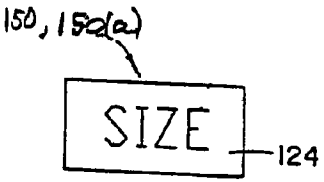
FIG. 10B illustrates a top view of the size indicators of FIGS. 10A and 10C.
Figure 10A:
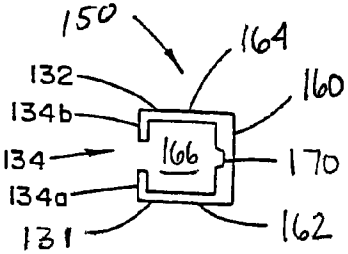

Referring now to FIGS. 10*a*, 10*b*, and 10*a* in combination, two versions of the size indicator are illustrated as 150 and 150*a*, with size indicator 150 generally having a face 160 and two sides 162, 164 depending therefrom to form a generally C-shaped channel 166. Each of the sides 162, 164 terminate in a foremost edge 131, 132. The foremost edges 131, 132 are preferably configured such that the cantilevered end 168 of the pivoting latch 142 is exposed when a size indicator 150 is secured on the web 128.

The size indicator 150 includes finger means 134 for engaging the fixed and pivoting latches 140, 142, respectively, such that the size indicator is secured on the web during normal use. However, the size indicator is releasably secured on the web 128 such that it may be released from the web 128 when the pivoting latch 142 is pivoted out of engagement with the finger means 134 of the size indicator when the release force ($F_R$) is applied. The finger means 134 preferably comprises an inwardly facing ridge 134*a*, 134*b* disposed at each of the foremost edges 131, 132 and projecting inwards towards the channel 166 of the size indicator 150.

In an alternative version, a second size indicator 150*a* of the first embodiment is illustrated in FIG. 10*c* in which like reference numerals refer to similar features, the second size indicator being referred to generally by reference numeral 150*a*. The second size indicator 150*a* has engagement abutments 162*a* and 164*a* which protrude from the inside of the sides 162, 164, respectively, to touch the side walls of the fixed and pivoting latches 140, 142 when secured to the web 128. As will be discussed below, the size indicator 150*a* further has a pair of spaced projections 160*a*, 160*b* projecting from an inner surface of the face 160.

Referring back to FIGS. 11*a* and 11*a* in combination, the web 128 preferably also has a guard 136 extending across the web 128 and below the size indicator 150*a*. In a preferred implementation, the guard 136 has a down-turned portion 138, which follows the contours of the cantilevered end 168 to thereby enable access to the edges of the size indicator, and the engagement means prevents inadvertent actuation of the pivoting latch 142. The cantilevered end 168 and engagement means are preferably configured to engage a tool (not shown) used for application of the releasing force ($F_R$). The engagement means is preferably a dimple 141 formed on a side of the cantilevered end 168. The tool having a tip substantially conforming to the shape of the dimple 141 and having a width such that it is not prevented from engaging the dimple 141 by the guard 136.

The web preferably also has an outermost edge 128*d* having an outermost portion 128*e* of a predetermined cross-section. The first version of the size indicator 150 has a trough 170*c* (FIG. 10*a*) with a mating cross-section substantially configured to receive the outermost portion 128*e* therein for preventing a lateral movement of the size indicator along direction E—E (FIG. 12*a*) when the size indicator 150 is secured on the web 128. The preferable predetermined cross-section of both the outermost portion 128*e* and the trough 170 is substantially rectangular. The second version of the size indicator 150*a* having first and second spaced projections 160*a* and 160*b*, respectively, which project from the inner surface of the face 160. The first and second projections 160*a*, 160*b* are spaced such that the outermost portion 128*e* is accepted therein when the size indicator 150*a* is secured on the web 128 to prevent lateral movement of the size indicator 150*a* along direction E—E (illustrated in FIG. 12*a*).

The engagement abutments 162*a*, 164*a* cooperate with the trough 170 or the first and second spaced projections 160*a*, 160*b* to prevent side-to-side movement of the size indicator on the web and contribute to a secure and solid attachment of the size indicator tot he hanger.

Referring to FIG. 11*b*, the web 128 further comprises locating means for locating the size indicators 150, 150*a* in a predetermined position on the web 128. The locating means preferably comprises first and second guides 146*a*, 146*b* disposed adjacent each side edge 148*a*, 148*b* of the size indicator 150, 150*a* and spaced apart to align the size indicators therebetween and to center the size indicators during application thereof on the web 128. Preferably, the first and second guides 146*a*, 146*b* do not extend the full length of the side edges 148*a*, 148*b* of the size indicator but define elongate openings 150*a*, 150*b* which expose the side edges 148*a*, 148*b* of the size indicator.

Referring now to FIGS. 12*a* and 12*a*, the operation of the garment hanger 100 of the present invention will be explained with regard to size indicator 150*a*. Size indicator 150*a* is mounted on the web 128 by sliding it over web 128 in the direction of arrow C. While being mounted in the direction of arrow C, the pivoting latch 142 pivots in the direction of arrow G until the inwardly facing ridges 134*a*, 134*b* of finger means 134 pass over the fixed and pivoting ridges 140, 142. After which, the inwardly facing fingers 134*a*, 134*b* snap into place in an area defined by the guide 136 and a bottom edge of the fixed and pivoting ridges 140, 142. As such, the size indicator 150*a* is releasably secured on the web 12B.

To release the size indicators 150, 150*a* from the web 128, a releasing force ($F_R$) is applied to the cantilevered end 168 of the pivoting latch 142, preferably by engaging the dimple 141 thereon with a release tool (not shown). The release force ($F_R$) results in the pivoting latch 142 to pivot about the living hinge 130 in the direction of arrow G. As can be seen in FIGS. 12*a* and 12*b*, planar side wall of the pivoting latch 142 causes the inner ridge 134*a* of the finger means 134 of size indicators 150, 150*a* to extend past the furthest extending portion of the fixed latch 140. At this point, the size indicator 150, 150*a* may be manually removed from the web 128.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A nestable hanger comprising:

a support means for supportably hanging the hanger on a display, the support means comprising a hook;

a body supported by the support means and having two pinch grips disposed thereon for retaining a garment therein; and nesting means for nesting the hanger in a stack of similar hangers such that the hanger interlocks with the stack of similar hangers, the body having a cut-out portion corresponding to at least a portion of a hook on the stack of similar hangers to accommodate the hook in the stack of similar hangers while nested together in the stack.

2. The nestable hanger of claim 1, wherein the hanger is in a plane substantially parallel with a plane of the stack of similar hangers.

3. The nestable hanger of claim 1, wherein the hanger is in substantially a same plane as the stack of similar hangers.

4. The nestable hanger of claim 1, wherein the two pinch grips being equidistant from the hook on opposite ends of the body in a first direction, the pinch grips further being offset in a second direction orthogonal to the first direction by an amount equal to a thickness of at least a portion of a corresponding hook in the stack of similar hangers.

5. The nestable hanger of claim 1, wherein the support means is rotatably disposed in the body.

6. The nestable hanger of claim 1, wherein the nesting means comprises the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a corresponding pocket of the similar hangers in the stack of hangers.

7. The nestable hanger of claim 6, further comprising means for preventing inadvertent actuation of the pinch ends while the garment is inserted between the pinch ends.

8. The nestable hanger of claim 7, wherein the means for preventing inadvertent actuation of the pinch ends comprises at least one guard member disposed on the actuation end of the first jaw, the at least one guard member projecting outwardly from the first jaw toward the actuation end of the second jaw such that an inadvertent actuation force is at least partially blocked from being applied to the actuation end of the second jaw.

9. The nestable hanger of claim 7, wherein the means for preventing inadvertent actuation of the pinch ends comprises at least one of the first and second jaws having a shape such that a widest portion of the pinch grip in a direction orthogonal to the axis of rotation is below the axis of rotation.

10. The nestable hanger of claim 1, wherein the support means is integrally formed with the body.

11. The nestable hanger of claim 10, further comprising a size indicator disposed on a transition portion between the hook and the body.

12. A nestable hanger comprising:

a hook for supportably hanging the hanger on a display; and a body supported by the hook and having two pinch grips disposed thereon for retaining a garment therein;

wherein the body having a cut-out portion corresponding to at least a portion of a hook on a stack of similar hangers to accommodate the hook in the stack of similar hangers while nested together in the stack.

13. A stack of hangers comprising:

a plurality of nestable hangers, each individual hanger in the plurality of nestable hangers being nested with at least one other individual hanger in the plurality of hangers, each individual hanger comprising:

a support means for supportably hanging the individual hanger on a display, the support means comprises a hook;

a body supported by the support means and having two pinch grips disposed thereon for retaining a garment therein; and nesting means for nesting the individual hanger in the stack of hangers such that the individual hanger interlocks with a corresponding hanger in the stack of hangers, the body having a cut-out portion corresponding to at least a portion of a corresponding hook on the stack of hangers.

14. The stack of hangers of claim 13, wherein each of the individual hangers is in a plane substantially parallel with a plane of each of the other plurality of hangers in the stack of hangers.

15. The stack of hangers of claim 13, wherein each of the individual hangers is in substantially a same plane as each of the other plurality of hangers in the stack of hangers.

16. The stack of hangers of claim 13, wherein the two pinch grips being equidistant from the hook on opposite ends of the body in a first direction, the pinch grips further being offset in a second direction orthogonal to the first direction by an amount equal to a thickness of at least a portion of a corresponding hook in the stack of hangers.

17. The stack of hangers of claim 13, wherein the nesting means comprises the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a corresponding pocket of the hangers in the stack of hangers.

18. The stack of hangers of claim 17, wherein each of the individual hangers further comprise means for preventing inadvertent actuation of the pinch ends while the garment is inserted between the pinch ends.

19. The stack of hangers of claim 18, wherein the means for preventing inadvertent actuation of the pinch ends comprises at least one guard member disposed on the actuation end of the first jaw, the at least one guard member projecting outwardly from the first jaw toward the actuation end of the second jaw such that an inadvertent actuation force is at least partially blocked from being applied to the actuation end of the second jaw.

20. The stack of hangers of claim 18, wherein the means for preventing inadvertent actuation of the pinch ends comprises at least one of the first and second jaws having a shape such that a widest portion of the pinch grip in a direction orthogonal to the axis of rotation is below the axis of rotation.

21. The stack of hangers of claim 13, wherein the support means for each of the individual hangers in the plurality of hangers is integrally formed with the body.

22. The stack of hangers of claim 21, further comprising a size indicator disposed on a transition portion between the hook and the body on each of the individual hangers in the plurality of hangers.

23. The stack of hangers of claim 13, wherein the support means for each of the individual hangers in the plurality of hangers is rotatably disposed in the body.

24. A stack of hangers comprising:

a plurality of nestable hangers, each individual hanger in the plurality of nestable hangers being nested with at least one other individual hanger in the plurality of hangers, each individual hanger comprising:

a hook for supportably hanging the individual hanger on a display; and a body supported by the hook and having two pinch grips disposed thereon for retaining a garment therein;

wherein the body having a cut-out portion corresponding to at least a portion of a hook disposed on the stack of hangers to accommodate the hook in the stack of hangers while nested together in the stack.

25. A container of hangers comprising:

walls defining an interior; and a plurality of stacks of hangers disposed in the interior, each of the individual stacks of hangers comprising a plurality of nestable hangers, each individual hanger in the plurality of nestable hangers being nested with at least one other individual hanger in the plurality of hangers, each individual hanger comprising:

a support means for supportably hanging the individual hanger on a display, the support means comprises a hook;

a body supported by the support means and having two pinch grips disposed thereon for retaining a garment therein; and nesting means for nesting the individual hanger in the stack of hangers such that the individual hanger interlocks with a corresponding hanger in the stack of hangers, the body having a cut-out portion corresponding to at least a portion of a corresponding hook on the stack of hangers.

26. The container of hangers of claim 25, wherein each of the individual hangers is in a plane substantially parallel with a plane of each of the other plurality of hangers in the stack of hangers.

27. The container of hangers of claim 25, wherein each of the individual hangers is in substantially a same plane as each of the other plurality of hangers in the stack of hangers.

28. The container of hangers of claim 25, wherein the two pinch grips are equidistant from the hook on opposite ends of the body in a first direction, the pinch grips further being offset in a second direction orthogonal to the first direction by an amount equal to a thickness of at least a portion of a corresponding hook in the stack of hangers.

29. The container of hangers of claim 25, wherein the nesting means comprises the pinch grips each having first and second jaws, the first jaw being disposed on the body and the second jaw being pivotally disposed with respect to the first jaw about an axis of rotation, each of the first and second jaws having a pinch end and an actuatable end, the pinch ends being biased together and being actuated apart by an actuation force applied at the actuation ends, the actuatable ends defining a pocket having a shape and size larger than a size and shape of the pinch ends such that the pinch ends are accommodated into a corresponding pocket of the hangers in the stack of hangers.

30. The container of hangers of claim 29, wherein each of the individual hangers further comprise means for preventing inadvertent actuation of the pinch ends while the garment is inserted between the pinch ends.

31. The container of hangers of claim 30, wherein the means for preventing inadvertent actuation of the pinch ends comprises at least one guard member disposed on the actuation end of the first jaw, the at least one guard member projecting outwardly from the first jaw toward the actuation end of the second jaw such that an inadvertent actuation force is at least partially blocked from being applied to the actuation end of the second jaw.

32. The container of hangers of claim 30, wherein the means for preventing inadvertent actuation of the pinch ends comprises at least one of the first and second jaws having a shape such that a widest portion of the pinch grip in a direction orthogonal to the axis of rotation is below the axis of rotation.

33. The container of hangers of claim 25, wherein the support means for each of the individual hangers in the plurality of hangers is integrally formed with the body.

34. The container of hangers of claim 33, further comprising a size indicator disposed on a transition portion between the hook and the body on each of the individual hangers in the plurality of hangers.

35. The container of hangers of claim 25, wherein the support means for each of the individual hangers in the plurality of hangers is rotatably disposed in the body.

36. A container of hangers, the container comprising:

walls defining an interior; and a plurality of stacks of hangers disposed in the interior, each of the individual stacks of hangers comprising a plurality of nestable hangers, each individual hanger in the plurality of nestable hangers being nested with at least one other individual hanger in the plurality of hangers, each individual hanger comprising:

a hook for supportably hanging the individual hanger on a display; and a body supported by the hook and having two pinch grips disposed thereon for retaining a garment therein;

wherein the body having a cut-out portion corresponding to at least a portion of a hook disposed on the stack of hangers to accommodate the hook in the stack of hangers while nested together in the stack.

37. A method for transporting hangers, the method comprising:

providing a nestable pinch-grip hanger comprising:

a support means for supportably hanging the hanger on a display, the support means comprising a hook;

a body supported by the support means and having two pinch grips disposed thereon for retaining a garment therein; and nesting means for nesting the hanger in a stack of similar hangers such that the hanger interlocks with the stack of similar hangers, the body having a cut-out portion corresponding to at least a portion of a hook on the stack of similar hangers to accommodate the hook in the stack of similar hangers while nested together in the stack;

nesting a plurality of the nestable pinch-grip hangers into at least one stack of hangers; and transporting the at least one stack of hangers between destinations.

38. The method of claim 37, wherein the at least one stack of hangers comprises a plurality of stacks of hangers, wherein the transporting further comprises stacking the plurality of stacks of hangers in a shipping container and transporting the shipping container between the destinations.

39. A method for handling hangers, the method comprising:

providing a nestable pinch-grip hanger comprising:

a support means for supportably hanging the hanger on a display, the support means comprising a hook;

a body supported by the support means and having two pinch grips disposed thereon for retaining a garment therein; and nesting means for nesting the hanger in a stack of similar hangers such that the hanger interlocks with the stack of similar hangers, the body having a cut-out portion corresponding to at least a portion of a hook on the stack of similar hangers to accommodate the hook in the stack of similar hangers while nested together in the stack;

nesting a plurality of the nestable pinch-grip hangers into at least one stack of hangers;

feeding the at least one stack of hangers into a processing station of an automated hanger processing apparatus; and processing each of the plurality of nestable pinch-grip hangers in the at least one stack of hangers.

40. The method of claim 39, wherein the processing comprises inserting a garment on each of the plurality of nestable pinch-grip hangers in the at least one stack of hangers.

41. The method of claim 40, wherein the processing comprises inserting a size indicator on each of the plurality of nestable pinch-grip hangers in the at least one stack of hangers.

* * * * *